United States Patent [19]

Delacroix et al.

[11] Patent Number: 4,947,561

[45] Date of Patent: Aug. 14, 1990

[54] FRAME FOR CLOTH OR ARTISTIC CANVASES

[75] Inventors: Thierry Delacroix, Paris; Pascal Lefebvre, Levallois Perre, both of France

[73] Assignee: Cabinet Beau, Paris, France

[21] Appl. No.: 300,675

[22] Filed: Jan. 23, 1989

[30] Foreign Application Priority Data

Jan. 26, 1988 [FR] France ..... 88 00876
Dec. 7, 1988 [FR] France ..... 88 16082

[51] Int. Cl.[5] ..... D06C 3/08

[52] U.S. Cl. ..... 38/102.91; 160/392; 160/395

[58] Field of Search ..... 38/102.91; 160/378, 160/391, 395, 397, 383, 393, 394, 396, 392; 24/460, 461, 462; 52/716, 222; 49/462

[56] References Cited

U.S. PATENT DOCUMENTS

| | | | |
|---|---|---|---|
| 1,741,958 | 12/1929 | Shogren | 160/397 |
| 2,312,721 | 3/1943 | Lang | 160/392 |
| 3,103,083 | 9/1963 | Seeger | 160/392 X |
| 3,222,841 | 12/1965 | Lipof | 160/394 X |
| 3,321,885 | 5/1967 | Pratt | 160/395 X |
| 3,678,607 | 7/1972 | Tabor et al. | 38/102.91 |
| 3,729,045 | 4/1973 | MacDonald | 160/395 X |
| 3,757,479 | 9/1973 | Martinez | 52/222 |
| 3,783,931 | 1/1974 | Assael | 160/395 |
| 3,991,806 | 11/1976 | Abell | 160/395 X |
| 4,170,810 | 10/1979 | Peleg | 160/395 X |
| 4,387,125 | 6/1983 | Adell | 52/716 X |
| 4,539,734 | 9/1985 | Messerschmidt | 38/102.91 X |
| 4,790,037 | 12/1988 | Phillips | 52/222 X |

FOREIGN PATENT DOCUMENTS

| | | |
|---|---|---|
| 2505020 | 11/1982 | France . |
| 2601575 | 1/1988 | France . |

*Primary Examiner*—Andrew M. Falik
*Attorney, Agent, or Firm*—Martin Lukacher

[57] ABSTRACT

A frame for canvas or other cloth is made up of rectilinear sections assembled to form a predetermined polygonal shape having rectilinear sections of channel members (10, 12, 14) having several sides. Each channel member have at least one longitudinal groove (20) along one of the sides thereof. The groove receives the edge of a cloth (28) mounted to the frame. An elonagted tensioner (26) extends around the entire frame and is held securely in the groove (20); the latter being provided with a narrow slit (24).

8 Claims, 5 Drawing Sheets

FRAME FOR CLOTH OR ARTISTIC CANVASES

BACKGROUND OF THE INVENTION

1. Field of the Invention

The present invention relates to frames for artistic canvases and other cloth.

2. Description of the Prior Art

One of the major problems involved in the fabrication of frames for artistic canvases and the like is the fixation of the cloth over the frame under uniformly distributed tension.

Such frames have been traditionally fashioned out of wood with the cloth being attached, under tension, by glueing or tacking. This technique is often tedious and time-consuming. In addition, it is extremely difficult, if not impossible, to detach the canvas from the frame in order to be mounted on another frame, should that be necessary.

It is also practically impossible to disassemble the frame, which is sometimes necessary, particularly for large frames.

SUMMARY OF THE INVENTION

In an effort to alleviate these problems of the prior art, the present invention provides a frame comprising a certain number of rectilinear sections assembled in a predetermined polygonal shape, each of said sections comprising channel members having at least one longitudinal groover along the sides thereof, this groove being adapted to receive the edge of the cloth to be mounted on the frame, and an elongated tensioning means extending around the entire perimeter of the frame and held securely in the groove, characterized in that, in transverse cross-section the groove is provided with an opening in the form of a narrow slit.

A feature of the present invention is the possibility of easily attaching a canvas to a frame by first laying the cloth over the frame in such a way as to cover the groove with the cloth, then by forcing the tensioning means to penetrate into the groove through the narrow slit, the canvas thus being forced into the groove as well and placed under tension, uniformly distributed over its entire periphery.

In a preferred embodiment of the invention, the tensioning means takes the form of an elastic stripping of traverse cross-section generally complementary to the form of the groove.

The assembly is particularly simple and requires neither special tooling nor skills. In addition, the canvas can be easily removed from the frame.

The groove may also be U or V-shaped and the tensioning means is a single endless band held securely in the groove either by its own elasticity or by means of a tension device.

The channel members may be provided advantageously with two parallel grooves, allowing for the stretching of two canvases on the same frame, the first on the front and the second on the back. The channel member forming the lower portion of the frame may also be provided in the form of a track or rail, as taught in French patent 86 11261, adapted to accommodate a plurality of slides, allowing the stretching of an irregularly shaped canvas by means of cord attaching the canvas to the slides in a zig-zag manner.

Finally, a C or L-shaped trim section may be fitted onto the frame over the canvas edge.

Other features and advantages of the present invention will become more readily understood by persons skilled in the art through the following description in which reference is made to the accompanying drawings.

BREIF DESCRIPTION OF THE DRAWINGS

Referring now to the drawings in which like reference numerals denote like elements throughout the several views:

FIGS. 5, 6, 7 and 8 are sectional views of the several forms which may be given to the channel members according to the invention:

PREFERRED EMBODIMENT OF THE INVENTION

Figure 1:
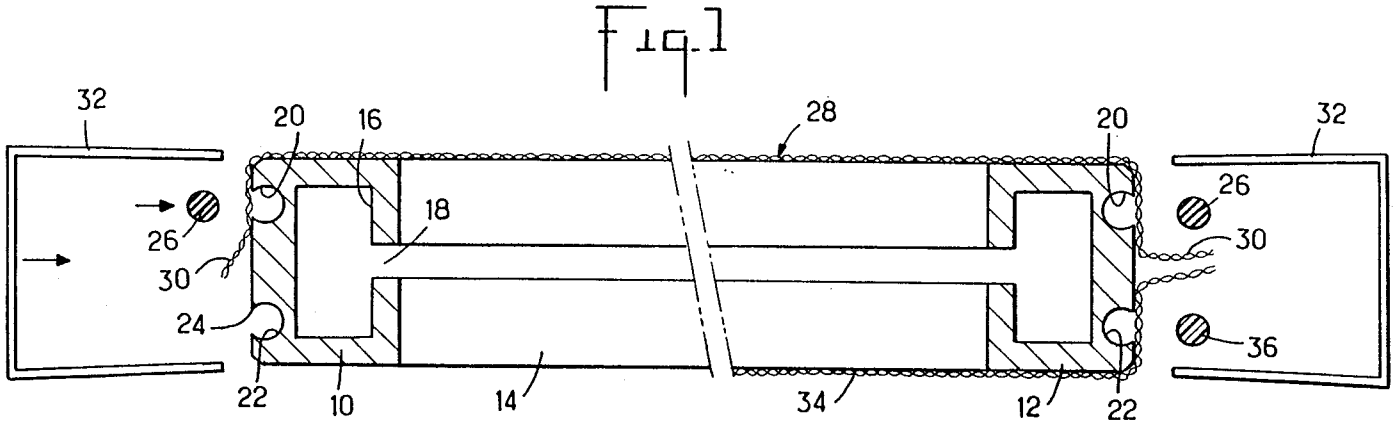
FIG. 1 and FIG. 2 are sectional views of the frame according to the invention onto which one or two canvases have been mounted, before and after the mounting of the canvases, respectively.
Figure 2:
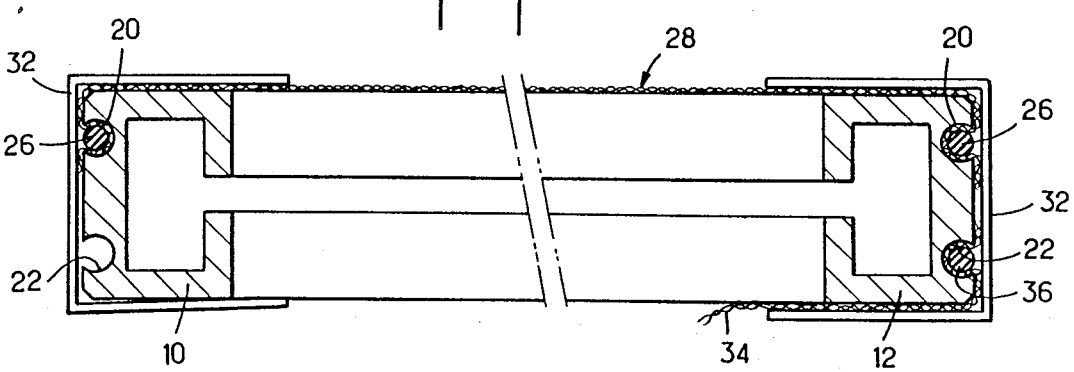

Referring now to the drawings, it will be seen in the sectional view of FIG. 1 three rectilinear sections forming channel members, two such members 10 and 12 being shown in transversal cross section with a third channel member 14 viewed frontally, assembled perpendicularly to form a rectangular frame.

Each rectilinear section of the frame consists of a hollow channel member having an internal track 16 ending in a slot 18 in the inner wall of the frame. On the surface opposite the slot 18, that is, on the outer wall of the frame, the channel member is provided with two grooves 20, 22 generally of semicircular cross-section open to the exterior by virtue of a narrow slit 24. The grooves extend over the entire length of the rectilinear sections.

The frame also comprises a tensioning member which in the figure takes the form of an elastic stripping 26, of which the cross section is generally complementary to the form of the grooves 20, 22. In the embodiment illustrated in FIG. 1 this cross section is circular.

In order to mount a cloth or canvas 28 on the frame, and to stretch the canvas thereon, the canvas is first laid over the frame, the edges 30 of the canvas being allowed to drape over the outer walls of the frame.

While the edges 30 of the cloth or canvas are held over the groove 20, the stripping 26 is forced to penetrate into the groove through the narrow slit 24 by virtue of the elasticity of stripping, which can be made of any suitable material such as rubber.

Thus the edges of the cloth or canvas are also forced into the groove effectively fixing the canvas to the frame under uniformly distributed tension, once the stripping has been introduced into the grooves of each of the channel members.

It will be easily seen that according to this embodiment, the stripping can be a single tensioning member surrounding the entire perimeter of the frame, or may be formed of a series of sections of length equivalent to that of the respective channel members.

The cloth 28 may be an artistic or painter's canvas, though the invention should not be conceived as being limited to such an application. The cloth may be stretched for decorative or other purposes and may be composed of textile fabric or any other supple sheet-like material.

If the cloth is an artistic canvas, after completion of the artistic work, the periphery of the frame can be covered with a trim 32 of C or L-shaped cross-section, which would simply fit over the channel members of the frame.

As a variant, as shown in the right portion of FIG. 1, a second canvas 34 may be fixed to the back of the frame, stretched by means of a second elastic stripping 36 forced along with the edges of that second canvas, into a second groove 22.

Figure 3:
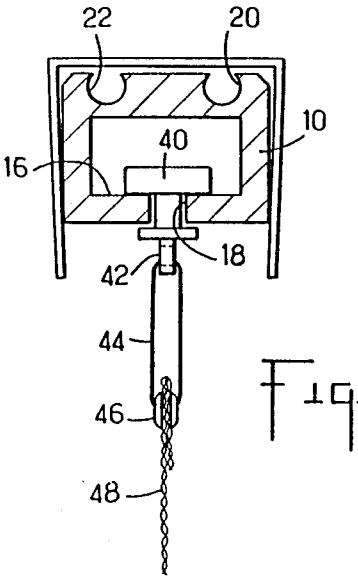
FIG. 3 is a partial sectional view of the same frame illustrated in FIG. 1 and FIG. 2, on which slides have been added in order to stretch a canvas.

FIG. 3 illustrates a manner in which the frame of the present invention is in accordance with the teachings of French patent application 86 11261.

A certain number of slides 40 are disposed in contact with the internal portion of the channel member forming the track 16. These slides terminate, on the outside of the slot 18, with eyelets 42 which accommodate attachment of a tensioning cord 44, laced in a zig-zag manner between eyelets 46 in the cloth 48 and the eyelets 42 of the slides.

As will be easily understood, in the application illustrated in FIG. 3 the grooves 20, 22 of the channel members are not utilized and a trim 32 can be fitted to cover the channel members and the slides.

Figure 4:
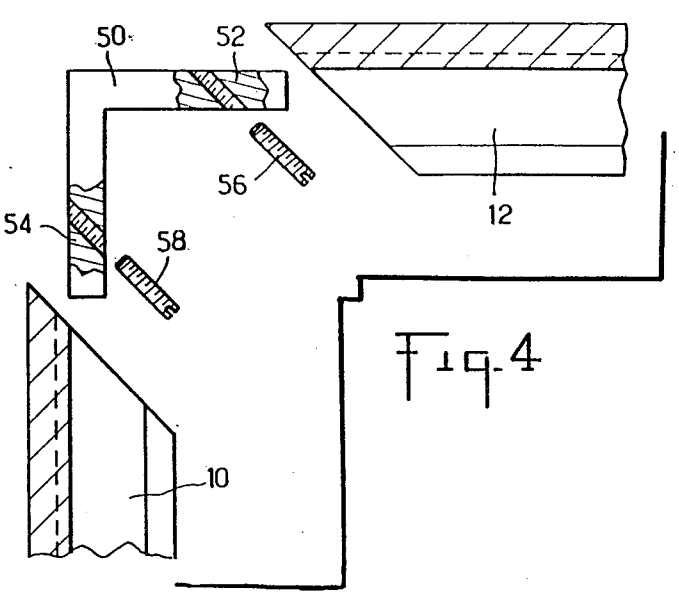
FIG. 4 is a detailed exploded view of the joint between two channel members of a frame.

In FIG. 4, a joining member in the form of an angle bracket 50 is shown which permits the assembly of two adjacent channel members 10 and 12.

The angle bracket 50 comprises two wing extensions 52 and 54 which are fitted inside the hollow channel members and provided with set screws 56, 58. Once the two channel members are fitted over the angle bracket, the set screws 56, 58 are tightened, access being had through the slot 18. The screws hold the channel members securely by jamming the inner cavity thereof.

As will be readily understood, the angle between the wing extensions of the angle bracket 50 may be different from the 90° shown in the figure. A series of brackets having extensions seperated by various angles can be provided so as to enable fabrication of frames in virtually any polygonal form.

Figure 6:
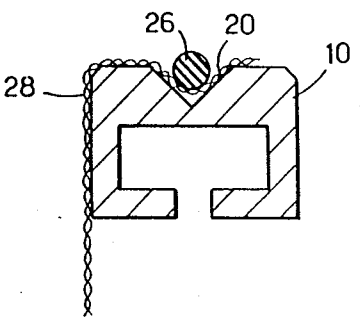
Figure 5:
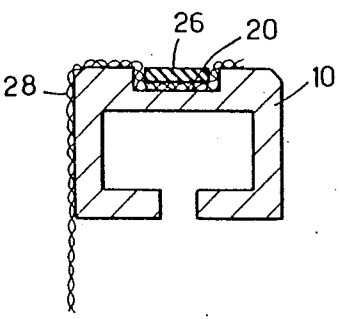
Figure 6:
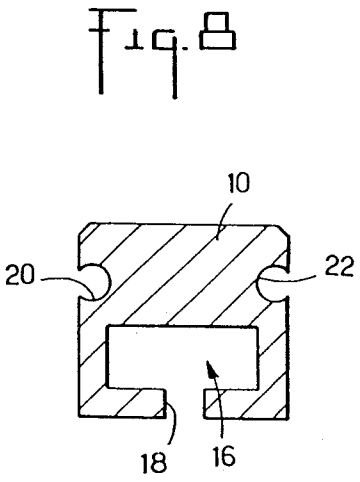

According to the alternatives shown in FIGS. 5 and 6, the grooves may have a U (FIG. 5) or V (FIG. 6) cross-section or any other suitable profile.

In the former case, the tensioning means may consist of an endless band of width generally equal to that of the groove. The band of width generally equal to that of the groove. The band may also be of a given length, that is, not endless, in which case the ends thereof will be provided with a tensioning device.

In the latter case, the tensioning means may consist of either an endless band as in the preceding case, or a stripping of the type described in relation to the other forms of groove.

It will be appreciated that although in the foregoing description reference was made to channel members provided with two grooves, frames composed of channel members with a single groove would fall within the scope of the invention.

Figure 7:
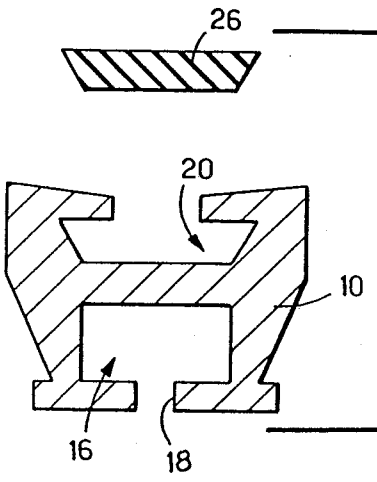

Such an arrangement is illustrated in the FIG. 7 wherein however, the groove has a trapezoidal cross-section. In such an arrangement, a single or two canvases may be fitted, both held in same groove.

Furthermore, the groove may be provided in an edge of the channel members corresponding to the faces thereof, as shown in the FIG. 8.

The materials used for the various components are those typically used in the art, such as:

metal, plastic or composite materials for the channel members:

rubber, foam rubber or other elastomers for the stripping:

metal or plastic materials, decorative or other for the trim:

textile ribon or elastomers for the tensioning device.

Figure 9:
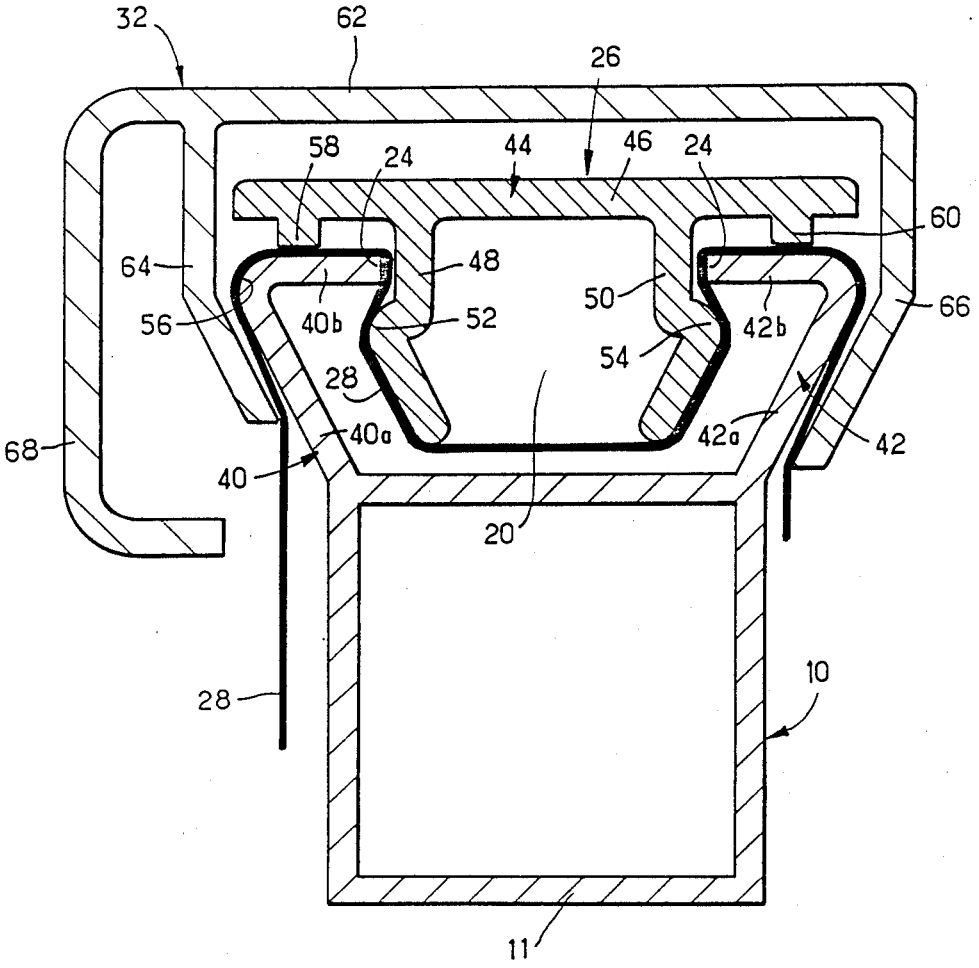
FIG. 9 and FIG. 10 are sectional views of two alternative structures analogous to that pictured in FIG. 7.

FIG. 9 illustrates a frame formed of channel members as shown in FIG. 7.

The central portion 11 of the channel member 10 is in the form of a hollow rectangle and, beginning at the upper corners thereof, two wall portions 60, 62 extend upward to define a groove 20 of trapezoidal cross-section.

The two wall portions each comprise a bottom portion **60*a*, 62*a* slightly inclined toward the outside, forming the inclined side walls of the trapezoid, and a top portion 60*b*, 62*b* extending back toward the inside, partially forming the longer parallel side of the trapezoid. The narrow slit 24 associated with the groove 20 is then defined by the space separating the top portions 60*b*, 62*b* of the wall portions 60, 62. The channel section 10** is preferably made of metal, and advantageously of aluminum.

The tensioning means 26 comprises an elongated cover strip having a flat base 66, of a width greater than that of the narrow slit, and two parallel ribs 68, 70 extending from the flat base 66. The outer surface of the two ribs are formed in such a way as to present shoulders 72, 74 acting as snapping catches in cooperation with the ends of the wall sections of the channel member 10, whereby the elastic deformation of the ribs permits the capturing of the ends of the canvas 28 to be stretched on the frame.

This embodiment enables the use of canvases 28 of various thicknesses while nevertheless insuring a correct tension due to the elasticity of the ribs 68, 70 of the cover strip 64.

Indeed, the channel members 10 are assembled such that the groove 20 is situated along the outer periphery of the frame. The canvas 28 is laid over the frame with the edges of the canvas draping over the narrow slit 24 of the grooves 24 in the outer periphery of the frame. Cover strips 64 are then forcibly engaged in the grooves 20, carrying with them the edges of the cloth, until the shoulders 72, 74 snap under the top portions **60*b*, 62*b* of the wall portions of the channel members, which define the narrow slit 24 of the grooves 20**.

It will be observed that the canvas must be folded back at the corners of the frame in order for the final appearance of the canvas to be neat. At locations corresponding to these folds, the tensioning cover strip 64 must capture three thicknesses of fabric. This is facilitated by the cover strip configuration.

Furthermore, by virtue of the fact that the wall portions 60, 62 of the channel section 10 diverge slightly from their base on the central portion 11 of the channel section 10, the canvas 28 rests, along the outermost edge of the frame, on an apex 76, thus precluding problems which might arise otherwise should paint drip between the canvas and the frame.

As shown in the figure, the flat base 66 of the cover strip 64 is provided with struts 78, 80 on the same side as the ribs 68, 70 and to the outside thereof for pressing against the top portions **60*b*, 62*b* of the wall portions forming the groove 20**.

It will be noted that the choice of a metal, notably aluminum, as the material for the channel section 10 makes unnecesaary the use of retightening devices, as are generally needed for conventional products with wooden frames.

Indeed, the tension under which the canvas is placed causes the entire frame to undergo an elastic deformation and every contraction or expansion of the canvas 28, notably due to variations in ambient hygrometric conditions, are translated into increases or reductions of the deformation of the frame, maintaining the cloth tension generally constant.

Materials such as wood or plastics undergo permanent plastic deformation, making such effects practically impossible.

Finally, as illustrated in the figure, the trim 32 of the frame consists in a section of C-shaped cross-section having two slightly convergent side extensions 84, 86 fitted over the channel section 10, and having on one side a masking portion 88 projecting toward the interior of the frame, thus masking the tensioning cover strip 64 as well as the borders of the canvas 28.

By virtue of this arrangement, the trim 32 is practically independent of the frame, which may be freely deformed, whereas the mitered corners of the trim may remain perfectly joined at all times.

Figure 10:
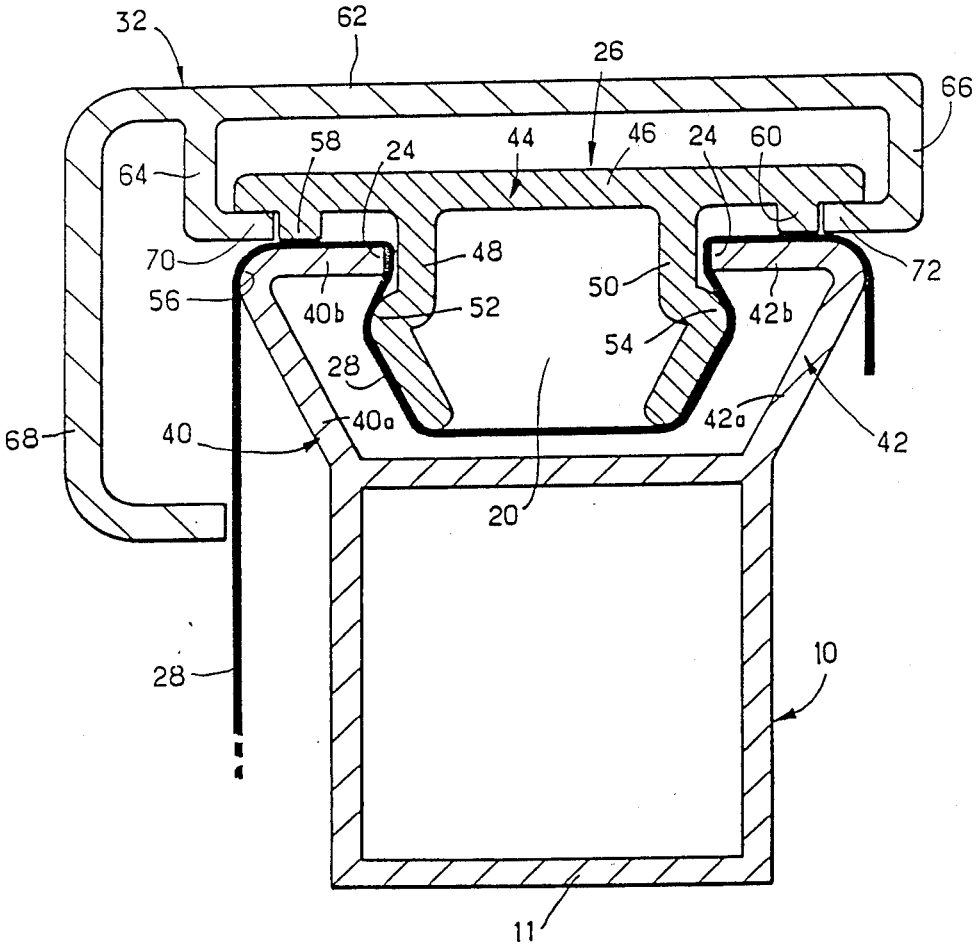

According to an alternative illustrated in FIG. 10, the section 82 forming the trim is hedl to the edges of the tensioning cover strip 64.

To accommodate such an arrangement, the two side extensions 84, 86 of the section forming the trim 32 terminate in two inwardly turning clipping edges 90, 92 which are engaged between the edges of the flat base 66 of the cover strip and the frame channel sections, at a point outside the ribs 78, 80.

By virtue of this arangement, direct contact of the side extensions 84, 86 with the canvas 28 is avoided.

It will be appearent to a man skilled in the art that the invention is not restricted to a frame wherein the channels members are provided with a groove 20 and a tensioning means is fitted therein, but also encompasses a frame wherein, on the contrary, the channel members are provided with a raised portion and the tensioning means are provided with a groove fitting over the raised portion of the channel members.

What is claimed is:

1. A frame comprising a plurality of rectilinear sections assembled to form a predetermined polygonal shape, said rectilinear sections comprising channel members (10, 12, 14) having several sides, each channel member having at least one longitudinal groove (20) along one of the sides thereof, said groove being suited for receiving the edge of a cloth (28) mounted on said frame, and an elongated tensioning means (26) extending around the entire frame and held securely in said groove (20), wherein said tensioning means is an endless band, the cross-sectional width of which is substantially equal to the width of said groove (20), wherein each of said channel members (10, 12, 14) further comprises a track portion (16) substantially opposite said at least one groove, and slides (40) running along said track.

2. A frame comprising a plurality of rectilinear sections assembled to form a predetermined polygonal shape, said rectilinear sections comprising channel members (10, 12, 14) having several sides, each channel member having at least one longitudinal groove (20) along one of the sides thereof, said groove being suited for receiving the edge of a cloth (28) mounted to said frame, and an elongated tensioning means extending around the entire frame and held securely in said groove (20), wherein said groove is provided with a narrow slit (24), and wherein each of said channel members (10, 12, 14) further comprises a track portion (16) substantially opposite said at least one groove, and slides (40) for running along said track.

3. A frame comprising a plurality of rectilinar sections assembled to form a predetermined polygonal shape said rectilinar sections comprising channel members (10, 12, 14) having several sides, each channel member having at least one longitudinal groove (20) along on the sides thereof, said groove having a narrow slit (24) entrance and being suited for receiving the edge of a cloth (28) mounted said frame, and an elongated tensioning means (26) extending the entire frame and held securely in said groove, wherein said groove (20) is provided with two reentrant flange members **(60*b*, 62*b*) defining therebetween said narrow slit entrance, and said tensioning means comprise an elongated cover strip having a flat base (66) having a width greater than that of the narrow slit entrance and two parallel ribs (68, 70) extending from the flat base substantially perpendicularly thereto and spaced from each other for substantially free insertion into said entrance, the two ribs having elastic properties and being provided with opposedly projecting shoulders (72, 74)** for snapping engagement below and inside of said flange members at either side of said entrance.

4. The frame according to claim 3 wherein the channel members are provided with two parallel grooves.

5. The frame according to claim 3 wherein the channel members are provided with a track portion and slides running along this track.

6. The frame according to claim 1 further comprising a removable C-shaped trim.

7. The frame according to claim 1 comprising a removable L-shaped trim.

8. The frame according to claim 1 wherein the channel members comprise inclined wall portions terminating at an apex (76) on which rests the cloth.

* * * * *